United States Patent [19]

Katsuuma

[11] 4,285,274

[45] Aug. 25, 1981

[54] SEAMLESS CYLINDRICAL PRINTING SCREEN AND PROCESS FOR PREPARATION THEREOF

[75] Inventor: Kunio Katsuuma, Osaka, Japan

[73] Assignee: Toshin Kogyo Co., Ltd., Hyogo, Japan

[21] Appl. No.: 87,382

[22] Filed: Oct. 22, 1979

[30] Foreign Application Priority Data

Jul. 5, 1979 [JP] Japan ..... 54-84426

[51] Int. Cl.[3] ..... B05C 17/06; B41L 27/28

[52] U.S. Cl. ..... 101/128.21; 101/128.4; 29/121.3; 29/121.4; 29/121.5

[58] Field of Search ..... 101/128.21, 128.4; 29/121.3, 121.4, 121.5

[56] References Cited

U.S. PATENT DOCUMENTS

| | | | |
|---|---|---|---|
| 1,906,284 | 5/1933 | Spencer | 29/121.3 |
| 2,287,122 | 6/1942 | Norris | 101/128.4 X |
| 2,592,789 | 4/1952 | Brennan | 101/128.21 |

*Primary Examiner*—Robert L. Lindsay, Jr.
*Attorney, Agent, or Firm*—Sherman & Shalloway

[57] ABSTRACT

Disclosed is a seamless cylindrical printing screen having an improved aperture ratio and high strength, rigidity and durability sufficient to resist the rotary screen printing operation and being capable of providing high quality printed patterns with sharp and clear contours. This screen is composed of a meshed metal cylinder, in which said cylinder comprises a plurality of axial mother lines composed of a metal wire and extended from one open edge of the cylinder to the other open edge substantially in the axial direction at small intervals between every two adjacent axial mother lines, a circumferential mother line composed of a metal wire and extended spirally from one open edge of the cylinder to the other open edge at small intervals between every two adjacent turns of the circumferential mother line to cross said axial mother lines and a metal plating layer covering the peripheries of said circumferential and axial mother lines and bonding them to one another at the crossing points thereof.

8 Claims, 10 Drawing Figures

SEAMLESS CYLINDRICAL PRINTING SCREEN AND PROCESS FOR PREPARATION THEREOF

BACKGROUND OF THE INVENTION (1) Field of the Invention

The present invention relates to a novel seamless cylindrical printing screen. More particularly, the invention relates to a seamless cylindrical screen having a novel structure, which comprises a metal wire net substrate in which all the crossing points are fixed by a plating layer and which has a match higher aperture ratio than in conventional cylindrical screens, and also to a process for the manufacture of such seamless cylindrical screen.

(2) Description of the Prior Art

A printing process in which the printing operation is carried out while driving and rotating a cylindrical screen synchronously with a material to be printed is known. This printing process is advantageous over a so-called flat screen printing process with respect to the printing equipment and operation. For example, the structure of the printing equipment is relatively simple and the printing operation is carried out while a material to be printed is being continuously fed. However, this cylindrical screen printing process is disadvantageous as compared with the printing process using a flat screen with respect to the quality of printed products.

In the cylindrical screen printing process, the printing operation must be conducted while the cylindrical screen is being driven and rotated. Accordingly, it is required that the mesh structure of the cylindrical screen should have higher strength and rigidity than in a flat screen. Therefore, the aperture ratio (the ratio of the open aperture area to the total area) of the cylindrical screen is inevitably much lower than that of the flat screen. When the aperture ratio is low, the quality of printed products is degraded for the following reasons.

(1) Since the viscosity of a printing paste or ink or a vinyl chloride resin paste, must be maintained at a low level, the clarity of the color formed by printing is low, and the amount of the printing ink or vinyl chloride resin paste applied per unit area is small.

(2) the sharpness of the printed pattern is low and in some case, a line is printed in a saw tooth-like shape. Furthermore, contours become fuzzy and get blurred. Accordingly, it is very difficult to reproduce a fine and delicate pattern.

Therefore, in the art of the rotary screen printing, development of a printing cylinder having a high aperture ratio has been eagerly desired.

Furthermore, in the printing process using a vinyl chloride resin paste, it is desired to use a cylinder having a larger thickness and a higher aperture ratio. Conventional cylinders, however, are defective in that if the thickness is increased, the aperture ratio is proportionally lowered.

Cylindrical screens formed by subjecting an embossed surface of a mother roll, that is, a meshed, electrically conductive surface of a mother roll, to nickel plating and drawing out a meshed cylinder formed as a plating layer from the mother roll have been widely used as the cylindrical screens in the rotary screen printing process. In cylinder screens of this type, however, since the rate of growth of the plating layer on the surface of the mother roll in the plane direction is two times the growth rate of the plating layer in the thickness direction, the mesh width becomes much larger than the mesh thickness and the aperture ratio is very low as shown below:

60 mesh: 10 to 20%
80 mesh: 6 to 10%
100 mesh: 3 to 7%
120 mesh: 3 to 5%

As another known cylindrical screen, there can be mentioned a meshed cylinder prepared by forming a metal layer by non-electrolytic plating on a tubular woven fabric composed of, for example, polyester fibers and forming a metal plating layer on this metal layer by electrolytic plating. This preparation method, however, is defective in that non-electrolytic plating and electrolytic plating, which are expensive and troublesome operations, should be performed. Moreover, in cylindrical screens of this type, it is difficult to maintain a mechanical or dimensional precision at a high level. Although the aperture ratio is improved in cylindrical screens of this type over the aperture ratio in cylindrical screens formed by performing the plating operation on the surface of a mother roll, the aperture ratio is still insufficient and low as shown below:

74 mesh: about 20%
107 mesh: about 15%
143 mesh: about 11%

Cylindrical screens formed by winding a plain-weave metal net in the cylindrical form and butt-welding or fusion-bonding the lapped portion of the net are also known. Cylindrical screens of this type, however, have a fatal defect that because of the presence of a seam, continuous patterns cannot be printed.

SUMMARY OF THE INVENTION

It has been found that when a seamless cylindrical wire net structure comprising axial mother lines and a circumferential mother line arranged spirally to cross the axial mother lines is plated with a metal, the respective mother lines are coated with the resulting metal layer and the respective crossing points are tightly fixed and integrated, whereby a seamless cylindrical screen having high strength and rigidity sufficient to resist the rotary screen printing and also having a remarkably improved aperture ratio can be obtained. The present invention is based on this finding.

It is therefore a primary object of the present invention to provide a seamless cylindrical printing screen having a much improved aperture ratio over the aperture ratio in conventional cylindrical screens while having sufficient strength, rigidity and durability (life) required in the rotary screen printing and being capable of forming clear printed patterns with sharp contours and reproducing fine and delicate patterns very clearly and sharply.

Another object of the present invention is to provide a seamless cylindrical printing screen having a novel structure including a cylindrical substrate of a crossing wire net, especially non-woven metal wire net, and a plating layer tightly fixing the crossing points of the net, and a process for the preparation of such seamless cylindrical printing screen.

Still another object of the present invention is to provide a seamless cylindrical printing screen formed of a non-woven metal net cylinder which can be obtained very easily at a low cost, and a process for the preparation of such seamless cylindrical printing screen.

A further object of the present invention is to provide a seamless cylindrical printing screen in which it is possible to increase the amount of a color paste, ink or printing resin paste or powder applied per unit area.

In accordance with one fundamental aspect of the present invention, there is provided a seamless cylindrical printing screen composed of a meshed metal cylinder, wherein said cylinder comprises a plurality of axial mother lines composed of a metal wire and extended from one open edge of the cylinder to the other open edge substantially in the axial direction of the cylinder at small intervals between every two adjacent axial mother lines, a circumferential mother line composed of a metal wire and extended spirally from one open edge of the cylinder to the other open edge at small intervals between every two adjacent turns of the circumferential mother line to cross said axial mother lines and a metal plating layer covering the peripheries of said circumferential and axial mother lines and bonding them to one another at the crossing points thereof.

This cylindrical printing screen of the present invention is advantageously prepared according to a process comprising arranging a plurality of axial mother lines composed of a metal wire and extended in the axial direction at small intervals between every two adjacent axial mother lines, on a support having an electrically non-conductive cylindrical surface, winding a metal wire on said axial mother lines spirally at small intervals between every two adjacent turns to cross said axial mother lines, thereby to form a circumferential mother line, subjecting the support having the axial and circumferential mother lines arranged on the circumferential surface thereof to a plating treatment to cover said mother lines with a metal plating layer and to fix them at the crossing points thereof, and drawing out the resulting integrated screen cylinder from the support. Of course, the preparation process is not limited to one described above.

BRIEF DESCRIPTION OF THE DRAWING

FIG. 4-B is a sectional view showing the screen of FIG. 4-A.

FIG. 5-B is a sectional view showing the screen of FIG. 5-A.

DETAILED DESCRIPTION OF THE PREFERRED EMBODIMENTS

Figure 1:
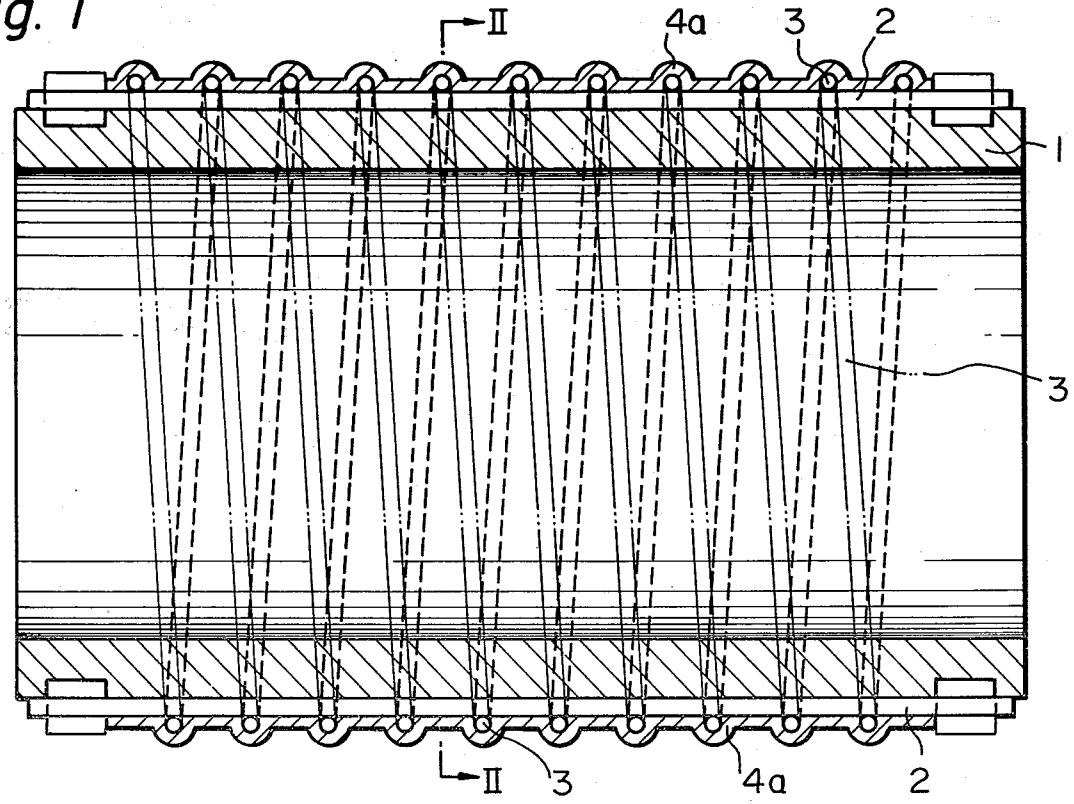
FIG. 1 is a sectional side view illustrating a cylindrical screen according to the present invention and a cylindrical support to be used for the preparation of this cylindrical screen.
Figure 2:
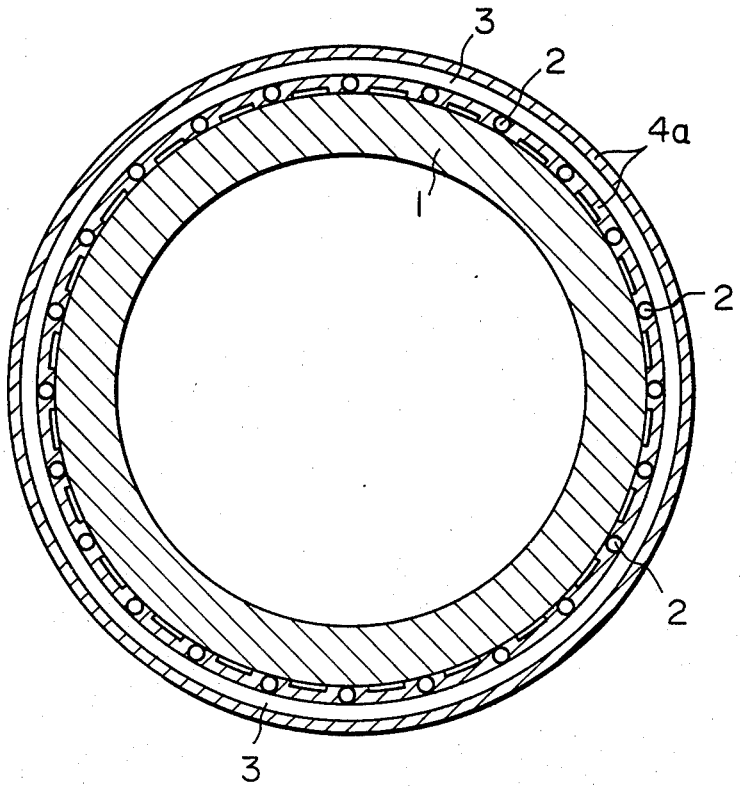
FIG. 2 is a view showing the section of the cylindrical screen and support of FIG. 1, taken along the line II—II in FIG. 1.
Figure 3A:
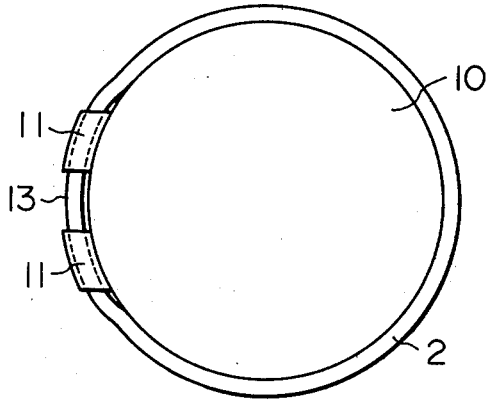
FIGS. 3-A, 3-B, 3-C and 3-D are diagrams illustrating the steps for arranging axial mother lines in the present invention.
Figure 3B:
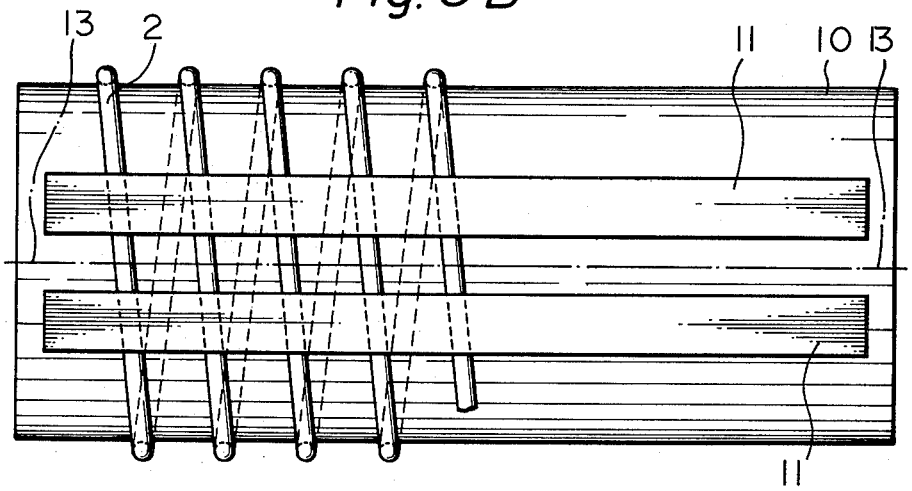
Figure 3C:
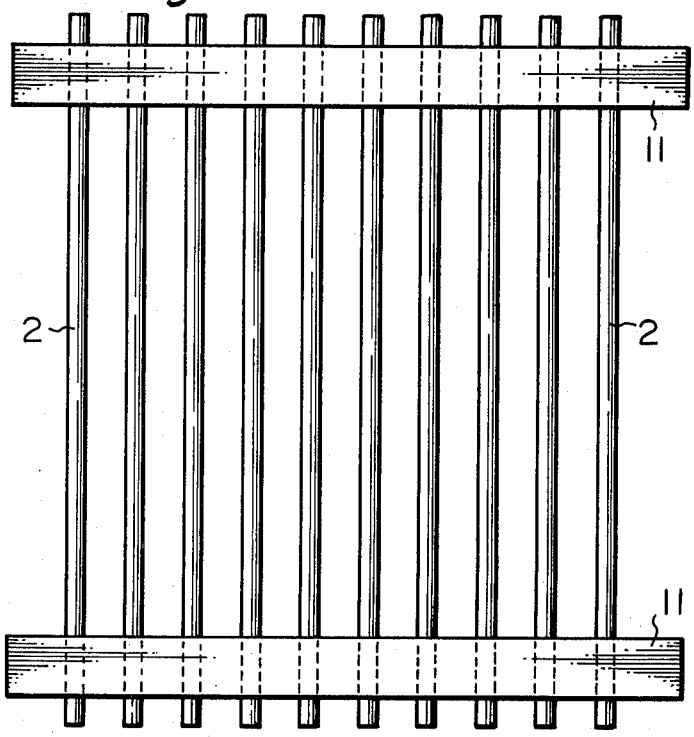
Figure 3D:
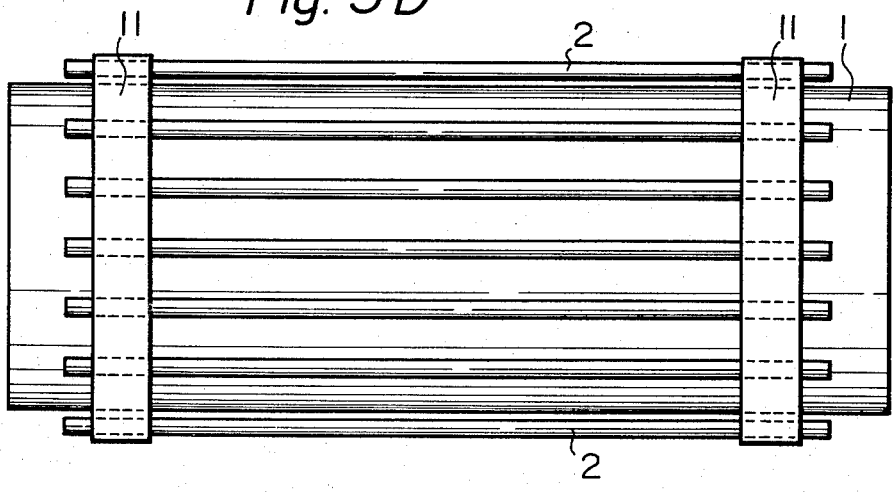

Referring to FIGS. 1 and 2 illustrating a seamless cylindrical screen according to the present invention and a process for the preparation thereof, a plurality of metal wires 2 are arranged on a peripheral surface of a support 1 having a cylindrical form so that they extend substantially in the axial direction from one open edge of the cylindrical support 1 to the other open edge of the cylindrical support 1 at small intervals between every two adjacent wires, whereby axial mother lines 2 are formed. A metal wire 3 is spirally wound on the axial mother lines 2 so that the wire 3 extends from one open edge of the cylindrical support 1 to the other open edge at small intervals between every two adjacent turns and it crosses the axial mother lines 2, whereby a circumferential mother line 3 is formed.

The diameter of the wire constituting the axial mother line 2 or circumferential mother line 3 and the interval between two adjacent wires or turns are determined according to the desired mesh size of the resulting screen. The material of the metal wire is not particularly critical. From the viewpoints of the strength and rigidity, however, a stainless steel wire and a piano wire are preferred. In order to facilitate the subsequent plating treatment, the surface of the metal wire may be preliminarily metal-plated to form a metal plating layer. It is preferred to use a metal wire having a diameter of 30 to 80 microns, though the desired diameter differs to some extent depending on the desired mesh size of the resulting screen.

Operations shown in FIGS. 3-A, 3-B, 3-C and 3-D may be adopted for arranging a plurality of metal wires as the axial mother lines on the surface of the support 1.

Referring to FIGS. 3-A and 3-B, on the surface of a cylindrical support 10 having an outer diameter substantially equal to the length of the axial mother line 2 and a length substantially equal to the outer diameter of the support 1 (the inner diameter of the final screen), two double-side adhesive tapes 11 are stuck with a certain distance therebetween. While rotating the cylindrical support 10 by means of a lathe or other tool, a metal wire 2 is spirally wound on the cylindrical support 10 at a certain pitch (corresponding to the interval between two adjacent axial lines). After completion of this winding operation, the spirally wound wire 2 is cut at a position 13 intermediate between the tapes 11, and rows of the cut wire 2 are peeled from the cylindrical support 10 in the state where the edge portions of the cut wire rows are fixed by the tapes 11 (see FIG. 3-C).

The so prepared wire rows 2 are wound on the periphery of the above-mentioned other support 1 by using the double-side adhesive tapes 11 and their positions are fixed. Thus, arrangement of the axial mother lines 2 is completed (see FIG. 3-D).

The operation of winding the circumferential mother line 3 is conducted in the same manner as described above by reference to FIGS. 3-A and 3-B by using a lathe or the like. By winding the circumferential mother line 3 on the axial mother lines 2, these mother lines 2 can be held on the support 1 in the state where they are tightly and closely stuck to the surface of the support 1. Accordingly, it is possible to obtain a cylindrical screen having a very high mechanical or dimensional precision.

In the present invention, as pointed out hereinbefore, it is preferred to use a non-woven metal net in which the axial mother lines 2 are arranged in the cylindrical form without being woven with the circumferential mother line 3. Of course, in the present invention, there may be employed a metal wire net composed of woven mother lines.

According to the present invention, the support 1 having the axial and circumferential mother lines 2 and 3 arranged on the cylindrical surface thereof is subjected to a plating treatment to cover the mother lines with a metal plating layer 4*a* and fix these mother lines at the crossing points thereof. The plating operation can be performed according to a known non-electrolytic or electrolytic plating method. Ordinarily, the electrolytic plating method is advantageously adopted. The kind of a metal to be plated is not particularly critical, but in view of the rust-preventing effect, strength and rigidity, nickel plating is especially preferred. It is ordinarily preferred that the thickness of the plating layer be adjusted within the range of 30 to 100 microns.

Since the mother lines arranged on the surface of the cylindrical support 1 are subjected to the plating treatment, at least the surface portion of the cylindrical support 1 should be composed of an electrically non-conductive material, and it is preferred that the material be acid-resistant and alkali-resistant so that it can sufficiently resist the plating treatment or preliminary treatment. Accordingly, a support composed of a resin, a rigid rubber, a glass material or a ceramic material is preferably used in the present invention. The outer diameter of the cylindrical support is appropriately determined after due consideration of the diameter of the metal wire, the thickness of the plating layer and the thickness of the final cylindrical screen so that the length of the periphery of the final screen becomes equal to a predetermined repeat length.

A cylindrical screen comprising axial and circumferential mother lines covered with a metal plating layer and fixed integrally with one other at the crossing points thereof by this metal plating layer is easily formed according to the foregoing procedures. The so formed cylindrical screen is drawn out from the cylindrical support 1, whereby the intended cylindrical screen is obtained.

The plating treatment may be conducted in one stage or in two or more stages. By the one-stage plating operation, a cylindrical screen which can be sufficiently used for the rotary screen printing operation, can be obtained. When it is desired to further improve the strength, rigidity and durability, the primarily plated cylindrical screen drawn out from the cylindrical support 1 is subjected to a secondary plating treatment to increase and ensure the covering effect of the plated metal.

Figure 4A:
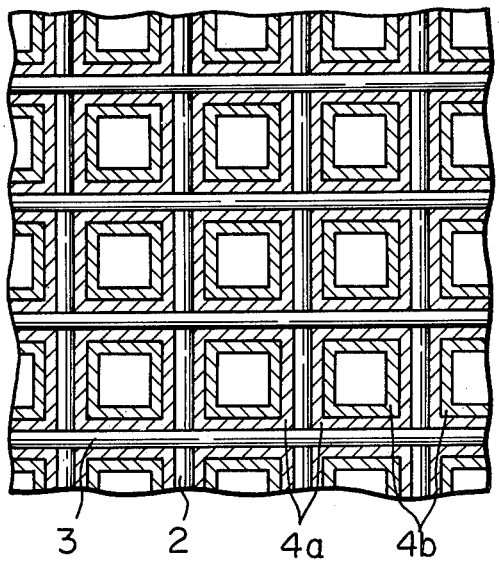
FIG. 4-A is a development plan view illustrating one preferred embodiment of the cylindrical screen according to the present invention.
Figure 4B:
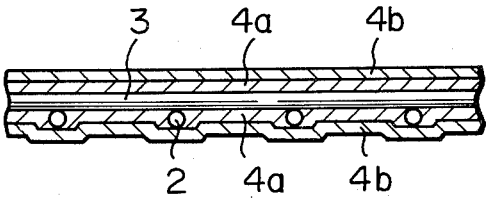

This preferred embodiment is illustrated in FIGS. 4-A and 4-B. In this embodiment, the axial and circumferential mother lines 2 and 3 are covered more completely with a primary metal plating layer 4*a* and a secondary metal plating layer 4*b*, and such properties as the durability and anti-corrosive property are further improved. When only the primary metal plating layer 4*a* is applied, the covering effect is often insufficient or incomplete in the portions of the axial mother lines 2 that fall in contact with the cylindrical support 1. If this preferred embodiment is adopted, a complete covering effect can be attained assuredly even in these portions.

As will be apparent from the foregoing illustration, in the cylindrical screen of the present invention, the axial mother lines 2 are ordinarily arranged on the inner face side of the cylindrical screen while the circumferential mother line 3 is arranged on the outer face side of the cylindrical screen.

Figure 5A:
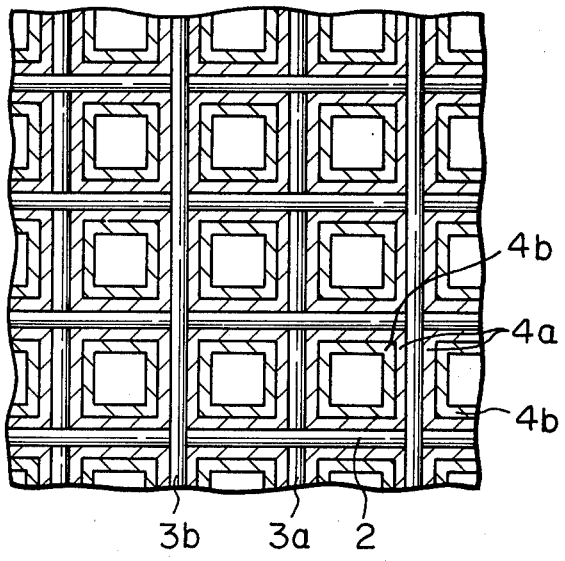
FIG. 5-A is a development plan view illustrating another preferred embodiment of the cylindrical screen according to the present invention.
Figure 5B:
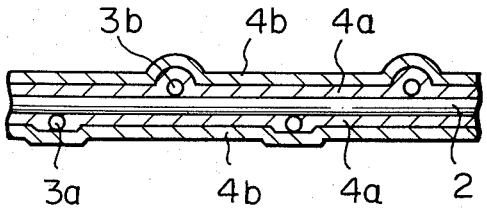

In the present invention, however, there may be adopted a structure in which an inner circumferential mother lne 3*a* and an outer circumferential mother line 3*b* are arranged on both the sides of the axial mother lines 2, as shown in FIGS. 5-A and 5-B, and these inner and outer circumferential mother lines 3*a* and 3*b* may be arranged alternately as clearly shown in FIG. 5-B. According to this embodiment, the thickness of the cylindrical screen can be increased without reduction of the aperture ratio in the final cylindrical screen. In other words, if a cylindrical screen according to this embodiment is employed, a color paste, an ink or a printing paste can be printed in a much increased amount without reduction of the sharpness of contours or degradation of the ability to reproduce a fine and delicate pattern.

In accordance with still another embodiment of the present invention, the axial mother lines 2 are arranged so that they are inclined from the axial direction of the cylinder by a certain angle, particularly 0° to 30°, to form rhombic apertures. In this embodiment, occurrence of the Moire phenomenon, which is readily caused in a screen printing operation using a screen having lattice-like apertures, can be effectively prevented.

In the present invention, by integrally covering a substrate comprising axial and circumferential mother lines crossing each other with a metal plating layer in the foregoing manner, there can be attained a prominent advantage that the aperture ratio can be remarkably increased while improving the properties required for the rotary screen printing operation, such as strength, rigidity and durability, over the conventional cylindrical screens. The cylindrical screen of the present invention has apertures of 40 to 200 mesh (the Tyler standard) and an aperture ratio of 60 to 7%, and the thickness can be changed within the range of 90 to 250 microns. In the cylindrical screen of the present invention, the relation between the mesh size and the aperture ratio is as shown below:

40 mesh: 50–60%
60 mesh: 40–53%
80 mesh: 35–45%
100 mesh: 27–35%
127 mesh: 18–25%
200 mesh: 7–10%

As will be apparent from the above data, the aperture ratio of the cylindrical screen of the present invention is unexpectedly higher than in the conventional cylindrical screens.

In the present invention, by using metal wires as the mother lines and forming a plating layer thereon, there can be attained various advantages in addition to the above-mentioned improvement of the aperture ratio. For example, since metal wires are characterized in that they have finest and most uniform dimensions among processed articles of metals and the surface is very smooth and free of scratches or other defects, by arranging such metal wires in the circumferential and axial directions of the cylinder where a high strength is required and applying a metal plating layer onto the peripheries and crossing points thereof, there can be obtained a cylindrical screen characterized by a very high dimension precision and having uniform meshes and apertures with a good surface smoothness of meshes.

Furthermore, when a film of a known light-curable resin composition is applied to the surface of the cylindrical screen of the present invention and exposed to actinic rays imagewise correspondingly to a pattern to be printed and the uncured portion of the film is removed, there can easily be obtained a printing plate. Accordingly, there can be attained an advantage that printed fabrics or sheets excellent in the quality of printed patterns can easily be prepared or printed molded articles can easily be formed from a resin paste or a resin granule or powder by using such printing plate.

What I claim is:

1. A seamless cylindrical printing screen composed of a meshed metal cylinder, wherein said cylinder comprises a plurality of axial mother lines composed of a metal wire and extended from one open edge of the cylinder to the other open edge substantially in the axial direction at small intervals between every two adjacent axial mother lines, a circumferential mother line composed of a metal wire and extended spirally from one open edge of the cylinder to the other open edge at small intervals between every two adjacent turns of the circumferential mother line to cross said axial mother lines and a metal plating layer covering the peripheries of said circumferential and axial mother lines and bonding them to one another at the crossing points thereof.

2. A seamless cylindrical printing screen as set forth in claim 1, wherein said circumferential and axial mother lines are arranged in the cylinder without being woven with one another.

3. A seamless cylindrical printing screen as set forth in claim 2, wherein the axial mother lines are arranged on the inner face side of the cylinder and the circumferential mother line is arranged on the outer face side of the cylinder.

4. A seamless cylindrical printing screen as set forth in claim 2, wherein the circumferential mother line includes an inner circumferential mother line and an outer circumferential mother line, which are arranged on both the sides of the axial mother lines, respectively.

5. A seamless cylindrical printing screen as set forth in claim 1, wherein each of the metal wires constituting the circumferential and axial mother lines has a diameter of 30 to 80 microns and the metal plating layer has a thickness of 30 to 100 microns.

6. A seamless cylindrical printing screen as set forth in claim 1, wherein the mesh size of the screen is in the range of 40 to 200 mesh (the Tyler standard) and the aperture ratio of the screen is in the range of 60 to 7%.

7. A seamless cylindrical printing screen as set forth in claim 1 wherein the metal wire is a stainless steel wire or piano wire and the metal plating layer is a nickel plating layer.

8. A seamless cylindrical printing screen as set forth in claim 1, wherein the axial mother lines are so that they are inclined from the axial direction of the cylinder by an angle of 0°to 30° C.

* * * * *